US010388495B2

(12) United States Patent
Gol'dberg et al.

(10) Patent No.: US 10,388,495 B2
(45) Date of Patent: Aug. 20, 2019

(54) PHOTOCATHODE ASSEMBLY OF VACUUM PHOTOELECTRONIC DEVICE WITH A SEMI-TRANSPARENT PHOTOCATHODE BASED ON NITRIDE GALLIUM COMPOUNDS

(71) Applicant: Aktsionernoe Obshchestvo "KATOD", Novosibirsk (RU)

(72) Inventors: Iosif Isaakovich Gol'dberg, Novosibirsk (RU); Aleksandr Vladimirovich Dolgikh, Novosibirsk (RU); Vladimir Il'ich Loktionov, Novosibirsk (RU)

(73) Assignee: AKTSIONERNOE OBSHCHESTVO "KATOD", Novosibirsk (RU)

( * ) Notice: Subject to any disclaimer, the term of this patent is extended or adjusted under 35 U.S.C. 154(b) by 0 days.

(21) Appl. No.: 16/318,858

(22) PCT Filed: Jun. 14, 2017

(86) PCT No.: PCT/RU2017/000415
§ 371 (c)(1),
(2) Date: Jan. 18, 2019

(87) PCT Pub. No.: WO2018/016990
PCT Pub. Date: Jan. 25, 2018

(65) Prior Publication Data

US 2019/0189408 A1 Jun. 20, 2019

(30) Foreign Application Priority Data

Jul. 19, 2016 (RU) ..... 2016129556

(51) Int. Cl.
*H01J 40/06* (2006.01)
*H01J 43/08* (2006.01)
*H01J 31/50* (2006.01)

(52) U.S. Cl.
CPC ..... *H01J 40/06* (2013.01); *H01J 31/50* (2013.01); *H01J 43/08* (2013.01); *H01J 2201/3423* (2013.01)

(58) Field of Classification Search
CPC ..... H01J 40/06; H01J 43/08; H01J 31/50
See application file for complete search history.

(56) References Cited

U.S. PATENT DOCUMENTS 612,612 A 10/1898 Lynds
6,597,112 B1 7/2003 Sillmon

FOREIGN PATENT DOCUMENTS

RU 2524753 C1 8/2014
SU 800682 A1 1/1981

OTHER PUBLICATIONS

International Search Report for the corresponding PCT/RU2017/000415; International Filing Date: Jun. 14, 2017; dated Oct. 5, 2017; 3 pages.

(Continued)

*Primary Examiner* — Joseph L Williams
(74) *Attorney, Agent, or Firm* — Muncy, Geissler, Olds & Lowe, P.C.

(57) ABSTRACT

A photocathode assembly of a vacuum photoelectronic device with a semi-transparent photocathode that consists of an input window in the form of a disk made from sapphire, layers of heteroepitaxial structure of gallium nitride compounds as a semi-transparent photocathode grown on the inner surface of the input window, and an element for connecting the input window with a vacuum photoelectronic device housing, which is vacuum-tight fixed on the outer surface of the input window at its periphery. The element for connecting of the input window with the vacuum photoelectronic device housing is made of a bimetal, in which a layer that is not in contact with the outer surface of the input window consists of a material with a temperature coefficient (Continued)

Figure 1:
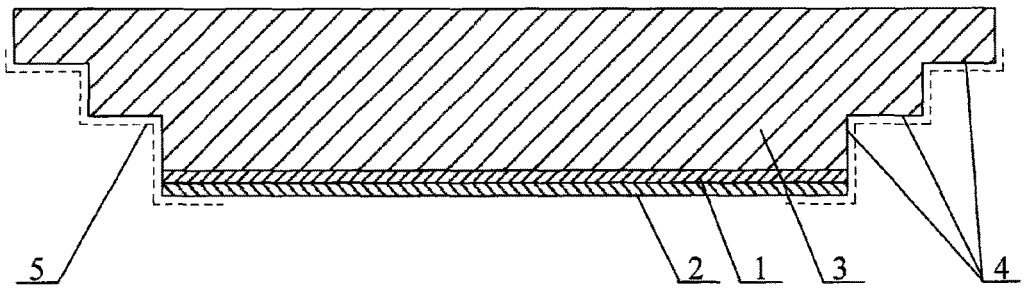

of linear expansion that differs from the temperature coefficient of linear expansion of sapphire by no more than 10% in the temperature range from 20° C. to 200° C.

6 Claims, 1 Drawing Sheet

(56) References Cited

OTHER PUBLICATIONS

Written Opinion for the corresponding PCT/RU2017/000415; International Filing Date: Jun. 14, 2017; dated Oct. 5, 2017; 3 pages.
Mizuno I. et al., "Development of UV image intensifier tube with GaN photocathode", Proc. SPIE 6945, Optics and Photonics in Global Homeland Security IV, 69451N (Apr. 15, 2008).

PHOTOCATHODE ASSEMBLY OF VACUUM PHOTOELECTRONIC DEVICE WITH A SEMI-TRANSPARENT PHOTOCATHODE BASED ON NITRIDE GALLIUM COMPOUNDS

CROSS-REFERENCE TO RELATED APPLICATIONS

This application is based on a 371 of PCT/RU2017/000415, filed Jun. 14, 2017, which claims benefit of Russian Patent Application No. 2016129556 filed on Jul. 19, 2016 which are incorporated herein by reference in their entirety.

The invention relates to the field of vacuum photoelectronic devices (hereinafter PED) operating in the ultraviolet spectrum region and comprising a photocathode based on gallium nitride compounds, and more specifically, to photocathode assemblies of such vacuum photoelectronic devices, and can be used in the designs of proximity-focused direct view electron-optical converters (hereinafter EOC), photomultiplier tubes and microchannel intensified position-sensitive detectors, manufactured by the separate processing of a photocathode part and a housing part.

The use of heteroepitaxial structures based on gallium nitride compounds, in particular based on GaN, AlGaN compounds, as semi-transparent photocathodes sensitive to the ultraviolet spectrum region is known. Known technologies for producing layers of heteroepitaxial structures based on gallium nitride compounds for such purposes suggest growing them on thin sapphire substrates with a thickness of 0.4 to 0.7 millimeters. As it is known, the most important characteristic of a photocathode is its quantum yield, which is determined by the number of emitted photoelectrons per an incident photon. The quantum yield of a photocathode material is determined by its properties, the state of its surface and the photon energy which must exceed a work function of the photocathode material. In order to reduce the work function of a heteroepitaxial structure grown on sapphire substrates, it is necessary to remove surface contaminations in such a way that makes its surface atomically clean. A surface of III-V group compounds is cleaned sufficiently by heating them under vacuum to a temperature close to the decomposition point. For gallium nitride compounds belonging to this group of compounds, the heating temperature is 600-620° C. At such temperatures, the heteroepitaxial structure of gallium nitride compounds grown on sapphire substrates is subjected, prior to its placement into the PED vacuum unit, to thermal cleaning under ultra-high vacuum and is activated by applying a layer of adsorbed electrically positive atoms, for example of cesium, and also by adding electronegative atoms, for example of oxygen. Activating the heteroepitaxial structure of the photocathode significantly reduces the photoelectron threshold (electronic work function) and, accordingly, provides the condition of negative electron affinity on the heteroepitaxial structure surface, thereby ensuring a high level of quantum yield (of photoelectron emission) of the photocathode.

Solutions of photocathode assemblies of vacuum photoelectronic devices comprising heteroepitaxial structures based on gallium nitride compounds grown on a sapphire substrate are known and described in the article by I. Mizuno, T. Nihashi, T. Nagai, M. Niigaki, Y. Shimizu, K. Simano, K. Katoh, T. Ihara, K. Okano, M. Matsumoto, M. Tachino "Development of UV image intensifier tube with GaN photocathode", Proc. Of SPIE Vol. 6945, 2008, as well as in the invention description of the patent RU 2524753 (published 10 Aug. 2014, IPC H01J31/50, H01J9/24).

According to the article by I. Mizuno et al., a heteroepitaxial structure of a gallium nitride compound p-GaN doped with magnesium for use thereof in an EOC was grown on a thin sapphire substrate having 1 inch in diameter and 0.7 mm thick, from which discs with a diameter of 20 mm were then cut and were coupled with a 5 mm thick sapphire input window made with a necessary profile. Before installing the photocathode in a housing of a vacuum unit of the photoelectronic device, it was subjected to heating up and activating in cesium and oxygen vapors. The known photocathode assembly of the vacuum photoelectronic device described in the article by I. Mizuno et al. is shown in FIG. 1. In the known photocathode assembly of the vacuum photoelectronic device, the thin sapphire substrate 1 (FIG. 1) with heteroepitaxial structure layers 2 grown thereon is bonded to an input window 3 made in the form of a thick profile sapphire disk. An adhesive coating 5 is applied on end surfaces 4 located at the periphery of the profile sapphire disk of the input window 3 to ensure vacuum-tight coupling at the end surfaces 4 of the photocathode assembly with the housing part of the photoelectronic device (not shown in Fig.), which is made by a known method of cold bonding via a gasket (not shown in Fig.) of a ductile metal, for example indium. A disadvantage of the solution of the photocathode assembly known from the article by I. Mizuno et al. is caused by the fact that the sapphire input window has a complex shape and therefore, due to considerable hardness of sapphire, the window is technically difficult and time-consuming to manufacture. At the same time, the technology of coupling the sapphire disk of the input window with the heteroepitaxial structure of gallium nitride compound GaN on the thin sapphire substrate also presents technological difficulties. Another disadvantage of the known solution of the photocathode assembly is a difficulty of heating the heteroepitaxial structure of gallium nitride compound, in this case the structure of GaN compound, under vacuum to a temperature of 600-620° C. necessary for creating favorable conditions for the subsequent process of its activation. The difficulty of heating the heteroepitaxial structure is due to the fact that heating under vacuum is carried out only by thermal radiation which is largely passed through sapphire, therefore the sapphire input window is not heated up well and does not transfer heat to the layers of the heteroepitaxial structure. The insufficient heating up of the heteroepitaxial structure before its activation does not allow obtaining a high level of the quantum yield of the photocathode. Also, a disadvantage of the known solution of the photocathode assembly is the large thickness of the input window caused by the requirement of mechanical strength during cold indium sealing of the vacuum unit, the presence of the end surfaces of the input window and also of adjacent surfaces of the sapphire substrate and of the sapphire disk of the input window. Such solution of the known photocathode assembly leads to a decrease in image contrast due to multiple reflections of light from the end surfaces and adjacent surfaces. In addition, the large thickness of the input window requires the use of a large quantity of quite expensive sapphire material.

A solution of a photocathode assembly of a vacuum photoelectronic device with a semi-transparent photocathode is known from the invention description of the patent RU 2524753 (published 10 Aug. 2014, IPC H01.131/50, H01J9/24), in which layers of a heteroepitaxial structure of gallium nitride compounds GaN, AlGaN are grown on a thin sapphire disc whose thickness is from 0.5 mm to 0.7 mm. The thin sapphire disk is simultaneously a substrate for the grown layers of the heteroepitaxial structure of the gallium nitride compounds GaN, AlGaN, and an input window. At the periphery of the sapphire disk of the input window, an element for coupling the input window with a housing of the vacuum photoelectronic device is thermo-compression bonded in vacuum-tight manner via an aluminum gasket, which element is made in the form of a flange. Disclosure of the patent RU 2524753 teaches that the element for coupling the input window with the housing of the vacuum photoelectronic device is made of titanium. The element for coupling the input window with the housing of the vacuum photoelectronic device is joined to it by a cold bonding method via a layer of a ductile metal, for example indium. The technical solution known from the patent RU 2524753 for the photocathode assembly of a vacuum photoelectronic device with a semi-transparent photocathode is adopted as the closest prior art to the claimed invention. The solution for the photocathode assembly of a vacuum photoelectronic device with a semi-transparent photocathode of the closest prior art eliminates disadvantages of the photocathode assembly of the vacuum PED described in the article by I. Mizuno et al. Namely, the solution for the photocathode assembly of the closest prior art, due to the presence of the element for coupling the input window with the housing of the vacuum photoelectronic device, said element being made in the form of a titanium flange, makes it possible to reduce the thickness of the sapphire disk of the input window, thereby simplifying the design of the photocathode assembly. Due to the small thickness of the sapphire disk and the absence of end and adjacent planes reflecting light, the design of the closest prior art eliminates the causes of deterioration of the image contrast in the finished vacuum photoelectronic device (in the case of use in an EOC). Also, due to the presence of the element for coupling the input window with the housing of the vacuum photoelectronic device in the form of a titanium flange in the design of the closest prior art, which element absorbs well and transfers heat to the layers of the heteroepitaxial structure, it is easier to input heat for heating the structure to the required temperature before activation. However, the photocathode assembly of a vacuum photoelectronic device with a semi-transparent photocathode of the closest prior art has disadvantages. Thus, in the design of the closest prior art, the titanium flange having a function of the element for coupling the input window with the housing of the vacuum photoelectronic device is vacuum-tightly attached to the surface of the sapphire disk. A vacuum-tight bond is made by the thermo-compression bonding method via an aluminum gasket at a temperature close to the melting point of aluminum and being 640° C. At this temperature, linear thermal expansion coefficients (hereinafter CLTE) of sapphire and of titanium are close to each other (CLTE of sapphire is $97.7\times10^{-7}$ $K^{-1}$, CLTE of titanium is $92.7\times10^{-7}$ $K^{-1}$), and therefore, in the process of thermo-compression bonding, at high heating temperatures of the elements to be bonded (the titanium element for coupling the input window with the PED housing and the sapphire disk of the input window), their linear dimensions change in an approximately equal, proportional extent. However, at lower temperatures, the linear thermal expansion coefficients of titanium and of sapphire are not matched to a large extent. For example, in the temperature range from 20 to 200° C., an average value of the linear thermal expansion coefficient of titanium is $81\times10^{-7}$ $K^{-1}$, and that of sapphire is $50\times10^{-7}$ $K^{-1}$. That is, in the process of making a bonded seal (a bond) between the photocathode assembly elements in this temperature range, the change in linear dimensions of the titanium element for coupling the input window with the PED housing occurs to a greater extent than the change in linear dimensions of the sapphire disk of the input window. This results in generation of significant stresses in the bond, under the influence of which an elastic deformation of the sapphire disk occurs and, as a consequence, a convex curvature of the plane of the sapphire disk appears. The convex curvature of the sapphire disk surface of the input window results in a corresponding convex curvature of the photocathode surface, since the layers of the heteroepitaxial structure forming the photocathode are grown on the surface of the sapphire disk. As results of practical tests show, in the photocathode assembly made according to the technical solution of the closest prior art, a deviation from the flatness of the sapphire disk of the input window in the form of its convexity and the corresponding convex curvature of the photocathode can be of 50 μm. In the case of using the photocathode assembly in a proximity-focused direct view electron-optical converter, such a degree of convexity of the photocathode has the following negative effect upon the image quality on the EOC screen, which effect is determined by a resolving power of the EOC. As it is known, a high resolving power on the EOC screen should be achieved both in the center of the screen and at the periphery thereof (the requirement of resolving power uniformity of resolving power over the operational field of the EOC screen). The resolving power of proximity-focused direct view electron-optical converters is largely determined by the size of an input interelectrode gap, i.e., a distance between the surface of the photocathode and the subsequent microchannel plate. In a proximity-focused direct view EOC, the highest resolving power degree on the screen is achieved by the smallest possible input interelectrode gap the value of which can be of 100 μm. If the input interelectrode gap value is of 100 μm and at the same time there is the 50 μm convexity of the photocathode in a proximity-focused direct view EOC, the input interelectrode gap value at the periphery thereof differs from the input interelectrode gap value in the center thereof by 50% upward. Such a large degree of increase in the input interelectrode gap from its center to the periphery causes a significant decrease in the image resolving power on the EOC screen in a direction from the center of the screen to the periphery thereof. Thus, the technical solution of the photocathode assembly of the closest prior art does not allow meeting one of the main requirements imposed on the proximity-focused direct view EOC and determining the image quality on its screen, i.e., the resolving power uniformity over the entire operational field of the EOC screen. This circumstance limits the use of the solution of the photocathode assembly of the closest prior art in proximity-focused direct view electro-optical converters, i.e., narrows its application area. At the same time, it is obvious that the stresses occurring in the bond due to the mismatch of the linear thermal expansion coefficients of sapphire and of titanium at relatively low temperatures remain after complete cooling of the photocathode assembly. The presence of significant residual stresses in the bond of the photocathode assembly causes the formation of microcracks in the aluminum gasket layer by means of which the bond is made. This causes an overall unreliability of the photocathode assembly and also prevents the required heating-up temperature of 600-620° C. of the heteroepitaxial structure before activation thereof from being achieved, since the subsequent high-temperature re-heating of the photocathode assembly in order to heat-up the heteroepitaxial structure grown on the input window as a semi-transparent photocathode can lead to an increase in the number and size of microcracks in the aluminum gasket layer and to a destruction of this layer up to a complete loss of the vacuum tightness of the bond and, as a consequence, to unsuitability of the photocathode assembly for further use as a part of the vacuum photoelectron device. As there is a high probability of breakdown of the vacuum tightness of the photocathode assembly of the closest prior art, its heating which provides simultaneous heating of the heteroepitaxial structure of the semi-transparent photocathode should be carried out at lower temperatures, which does not allow high values of the quantum yield of its semi-transparent photocathode to be achieved as a result. With an increase in the standard diameter of the photocathode and a corresponding increase in the diameter of the sapphire disk of the input window of the photocathode assembly, the probability of breakdown of the vacuum tightness of the bond increases. Obviously, this is due to a well-known dependence of the resistance to temperature stresses on the characteristic dimensions of the parts of the bond. For example, if the characteristic dimension of the bond is the diameter of a sapphire disk, then the resistance to temperature stresses in the bond will decrease as the diameter increases. Accordingly, under the influence of temperature stresses existing in the bond of the photocathode assembly as a result of the mismatch in the linear thermal expansion coefficients of sapphire and of titanium, the bond is weakened to a greater extent at relatively large diameters of the sapphire disc of the input window than at relatively small diameters thereof. Thus, for some specific values of the diameter of the sapphire disk, the magnitude of temperature stresses in the bond is higher than the ultimate strength of the aluminum layer of the bond, which leads to the formation of microcracks therein and the subsequent breakdown of the vacuum tightness thereof at different temperature exposures and mechanical impacts. It is obvious that the magnitude of the residual stresses generated in the bond of the photocathode assembly of the closest prior art causes such a degree of its design unreliability that does not allow its use for photocathodes having relatively large standard diameters, i.e. from 18 mm or more. It is also obvious that the probability of breakdown of the vacuum tightness of the bonded seal and hence of the photocathode assembly as a whole of the closest prior art also increases as its heating temperature increases. Indeed, the results of tests performed for the photocathode assemblies made according to the technical solution of the closest prior art and comprising photocathodes having standard diameters of 18 and 25 mm show that, when heated to temperatures of 450-500° C., their vacuum tightness is maintained. However, when heated to temperatures of 600-620° C., a breakdown of vacuum tightness in the photocathode assemblies having a standard photocathode diameter of 18 mm is observed in three percent of the tests and, in the photocathode assemblies having a standard photocathode diameter of 25 mm, a breakdown of vacuum tightness is present in one hundred percent of the tests. This circumstance limits the use of the known photocathode assembly design of a vacuum photoelectronic device with a semi-transparent photocathode of the closest prior art in photocathodes with relatively large standard diameters, i.e. from 18 mm or more, and therefore limits its application area. At the same time, the results of tests performed for the photocathode assemblies made according to the technical solution of the closest prior art show that, due to an insufficient heating-up of the semi-transparent photocathodes comprised therein which is limited to temperatures of 450-500° C., a quantum yield of the semi-transparent photocathodes obtained as a result of their subsequent activation is 40-50% lower than the quantum yield obtained by heating the semi-transparent photocathodes to temperatures of 600-620° C. However, the overall unreliability of the photocathode assembly of the closest prior art caused by the presence of residual stresses in the bond thereof reduces a resistance of the photocathode assembly to mechanical and climatic factors such as vibration, mechanical shocks, very high and low ambient temperatures, cyclic changes in temperature and humidity. The insufficient resistance of the photocathode assembly of the closest prior art to the mechanical and climatic factors can lead to a loss of operability of the vacuum photoelectronic device in which the photocathode assembly of the closest prior art is used. The listed disadvantages of the known solution of the photocathode assembly of the vacuum photoelectronic device with the semi-transparent photocathode of the closest prior art impair technical and operational performance thereof.

A technical problem to be solved in the claimed invention is to improve the technical and operational performance of the photocathode assembly of the vacuum photoelectronic device with the semi-transparent photocathode.

Said technical problem is solved by that, in a photocathode assembly of a vacuum photoelectronic device with a semi-transparent photocathode comprising an input window made in the form of a sapphire disk, layers of a heteroepitaxial structure of gallium nitride compounds as the semi-transparent photocathode, said layers being grown on an inner surface of the input window, and an element for coupling the input window with a housing of the vacuum photoelectronic device, said element being vacuum-tightly attached to an outer surface of the input window at its periphery, according to the claimed invention, the element for coupling the input window with the housing of the vacuum photoelectronic device is made of a bimetal in which a layer not in contact with the outer surface of the input window consists of a material having a linear thermal expansion coefficient different from the linear thermal expansion coefficient of sapphire by not more than 10% in the temperature range from 20° C. to 200° C.

In the claimed photocathode assembly of a vacuum photoelectronic device with a semi-transparent photocathode, the element for coupling the input window with the housing of the vacuum photoelectronic device is made of the bimetal in which the layer not in contact with the outer surface of the input window is made of a material having a linear thermal expansion coefficient different from the linear thermal expansion coefficient of sapphire by not more than 10% in the temperature range from 20° C. to 200° C. Due to such an arrangement, internal stresses generated during vacuum-tight thermo-compression bonding in a bond of the photocathode assembly due to the difference in linear thermal expansion coefficient values of the sapphire which the input window disk is made of, and of the material which the bimetal layer bonded to the sapphire disk is made of and the element for coupling the input window with the housing of the vacuum photoelectronic device is made of, is largely compensated by approximately equal (commensurate) and oppositely directed stresses generated due to the difference in linear thermal expansion coefficient values of the material of the layer bonded to the sapphire disk of the input window and of the material of the layer being not in contact with the outer surface of the sapphire disc of the input window. As a result of this compensation of the generated stresses, a degree of convex curvature of the plane of the sapphire disk of the input window and the corresponding degree of convexity of the semi-transparent photocathode are minimal, including those at relatively large diameters thereof, from 18 mm or more. Due to this, it becomes possible to meet the requirement of resolving power uniformity over the entire operational field of the screen, imposed on proximity-focused direct view electron-optical converters, and therefore, it becomes possible without limitations to use the claimed photocathode assembly within the converters, in particular those with photocathodes of relatively large standard diameters, from 18 mm or more. At the same time, as a result of such compensation of the stresses generated during bonding, residual stresses in the photocathode assembly also remain insignificant for being a cause of breakdown of the vacuum tightness of the bond of the elements of the photocathode assembly when it is high-temperature heated to a temperature close to the melting point of aluminum (the material of a gasket for vacuum-tight thermo-compression bonding), including when such heating is repeated. Thus, a strong vacuum-tight bond of the sapphire disk of the input window to the element for coupling the input window with the housing of the vacuum photoelectronic device is ensured. The claimed photocathode assembly reliability manifested in maintaining the integrity of its vacuum-tight bond at said high temperatures allows the photocathode assembly to be heated under vacuum to the temperatures of 600-620° C., thereby ensuring such a degree of surface cleaning of the heteroepitaxial structure of the gallium nitride compounds which is necessary for its effective activation, and hence allows for ensuring a high level of quantum yield of the semi-transparent photocathode of the photocathode assembly of the vacuum photoelectron device. At the same time, the reliability degree of the vacuum-tight bond of the claimed photocathode assembly attained at the high-temperature heating thereof up to the temperatures of 600-620° C. also ensures its vacuum tightness, and therefore its applicability in vacuum photoelectronic devices with photocathodes of relatively large standard diameters, from 18 mm or more, i.e., expands the application area of the photocathode assembly of the vacuum photoelectronic device.

Thus, technical results consisting in increasing the quantum yield of the semi-transparent photocathode of the photocathode assembly of the vacuum photoelectronic device, in expanding the application area of the photocathode assembly of the vacuum photoelectronic device with the semi-transparent photocathode, and in meeting the requirement for uniform resolving power over the operational field of the screen of the vacuum photoelectronic device in the case of using the claimed photocathode assembly in an proximity-focused direct view electro-optical converter are achieved by the claimed combination of essential features. The technical problem of improving the technical and operational performance of the photocathode assembly of the vacuum photoelectronic device with the semi-transparent photocathode is solved by means of the technical results achieved.

In the photocathode assembly of the vacuum photoelectronic device with the semi-transparent photocathode, kovar may be for example used as the material having a linear thermal expansion coefficient different from the linear thermal expansion coefficient of sapphire by not more than 10% in the temperature range from 20° C. to 200° C. Kovar is an alloy based on nickel (Ni) in an amount of 29%, cobalt (Co) in an amount of 17%, and iron (Fe) in the balance amount, which alloy has a linear thermal expansion coefficient value of $(46\text{-}52)\times10^{-7}\ K^{-1}$ (or an average value of $49\times10^{-7}\ K^{-1}$) in the temperature range from 20° C. to 200° C.

In the photocathode assembly of the vacuum photoelectronic device with the semi-transparent photocathode, the layers of the heteroepitaxial structure of gallium nitride compounds may include a GaN compound.

In the photocathode assembly of the vacuum photoelectron device with the semi-transparent photocathode, the layers of the heteroepitaxial structure of gallium nitride compounds may include an AlGaN compound.

In the photocathode assembly of the vacuum photoelectronic device with the semi-transparent photocathode, the element for coupling the input window with the housing of the vacuum photoelectronic device is made in the form of a rotation figure having a profile of predetermined shape.

In the photocathode assembly of the vacuum photoelectronic device with the semi-transparent photocathode, a thickness of the sapphire disk can be from 0.4 mm to 0.7 mm.

FIG. 1 shows the photocathode assembly of the vacuum photoelectronic device known from the article by I. Mizuno, T. Nihashi, T. Nagai, M. Niigaki, Y. Shimizu, K. Shimano, K. Katoh, T. Ihara, K. Okano, M. Matsumoto, M. Tachino, "Development of UV image intensifier tube with GaN photocathode", Proc. of SPIE Vol. 6945, 2008.

Figure 2:
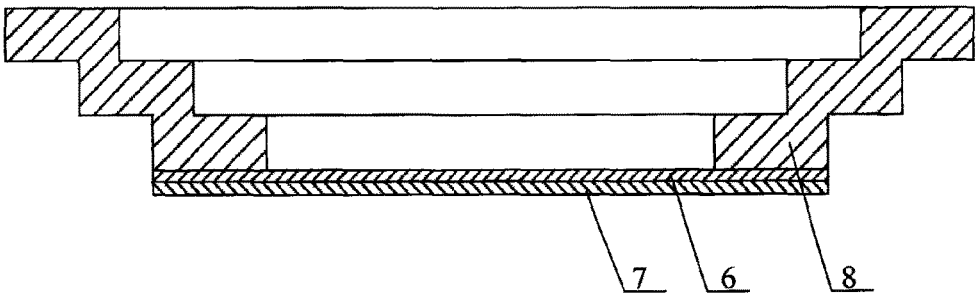

FIG. 2 shows the claimed photocathode assembly of a vacuum photoelectronic device with a semi-transparent photocathode based on gallium nitride compounds.

The claimed photocathode assembly of a vacuum photoelectronic device with a semi-transparent photocathode comprises (FIG. 2) an input window 6, layers 7 of a heteroepitaxial structure of gallium nitride compounds as the semi-transparent photocathode, and an element 8 for coupling the input window 6 with a housing of the vacuum photoelectronic device (not shown in Fig.). The input window 6 is shaped as a disk (this is not shown in Fig.) made of sapphire, wherein the layers 7 of the heteroepitaxial structure of gallium nitride compounds are grown on an inner surface of the input window 6, and the element 8 for coupling the input window 6 with the housing of the vacuum photoelectronic device is vacuum-tightly attached to an outer surface of the input window 6 at its periphery. The element 8 for coupling the input window 6 with the housing of the vacuum photoelectronic device is made of a bimetal in which a layer (not shown in Fig.) that is not in contact with the outer surface of the input window 6 consists of a material having a linear thermal expansion coefficient different from the linear thermal expansion coefficient of sapphire by not more than 10% in the temperature range from 20° C. to 200° C.

The claimed technical solution of the photocathode assembly of the vacuum photoelectronic device with the semi-transparent photocathode is implemented as follows. A semi-transparent photocathode of the photocathode assembly of the vacuum photoelectronic device is manufactured, for which purpose layers 7 of a heteroepitaxial structure of gallium nitride compounds are grown on a sapphire disk. Here, a diameter of the sapphire disk is chosen to be corresponding to one of the standard photocathode diameters which can be in particular of 18 mm or more. A thickness of the sapphire disk can be from 0.4 mm to 0.7 mm. The layers 7 of the heteroepitaxial structure of gallium nitride compounds can include GaN and/or AlGaN compounds, in particular as an active layer of the heteroepitaxial structure. The heterostructure of gallium nitride compounds is epitaxially grown by one of known methods. For example, an organometallic vapor phase epitaxy (OMVPE) method or a molecular-beam epitaxy (MBE) method is used for the epitaxial growth of GaN and AlGaN compounds. The sapphire disk used as a substrate for the layers 7 of the heteroepitaxial structure of gallium nitride compounds which are thus grown thereon and which form the semi-transparent photocathode is simultaneously used as the input window 6 of the photocathode assembly of the vacuum photoelectronic device. Here, a surface of the input window 6 on which the layers 7 of the heteroepitaxial structure of the gallium nitride compounds are grown is defined as its inner surface which is configured to be placed during the manufacture of the vacuum photoelectronic device within the internal volume of the vacuum PED housing. Another, free surface of the input window 6 is defined as its outer surface which is configured for vacuum-tight attachment thereto of the element 8 for coupling the input window 6 with the housing of the vacuum photoelectronic device during the manufacture of the photocathode assembly of the vacuum photoelectronic device. The element 8 for coupling the input window 6 with the housing of the vacuum photoelectronic device is manufactured by means of that layers of a bimetal are formed as a rotation figure having a profile of predetermined shape by one of known methods for manufacturing bimetallic parts. Here, a material having a linear thermal expansion coefficient different from the linear thermal expansion coefficient of sapphire by not more than 10% in the temperature range from 20° C. to 200° C. is used for the bimetal layer which is not in contact with the outer surface of the input window 6 in the finished photocathode assembly. For example, kovar which is an alloy based on nickel (Ni) in the amount of 29%, cobalt (Co) in the amount of 17%, and iron (Fe) in the balance amount, and has a linear thermal expansion coefficient value which is $(46\text{-}52)\times10^{-7}$ $K^{-1}$ (or an average value of $49\times10^{-7}$ $K^{-1}$) in the temperature range from 20° C. to 200° C. is used as said material. For the bimetal layer by which the element 8 for coupling the input window 6 with the housing of the vacuum photoelectronic device is attached to the outer surface of the input window 6 in the finished photocathode assembly, a material is chosen that ensures its vacuum-tight bonding to sapphire which the disk of the input window 6 is made of. For example, titanium is used as this material. The element 8 for coupling the input window 6 with the housing of the vacuum photoelectronic device can be manufactured, for example, by thermal-compression bonding to each other of two blanks of parts made in the form of rotation figures having profiles of predetermined shapes, so that the blanks form the bimetal layers one of which is not in contact with the outer surface of the input window 6 in the finished photocathode assembly. The manufactured element 8 for coupling the input window 6 with the housing of the vacuum photoelectronic device is vacuum-tightly attached to the outer surface of the input window 6 at its periphery, for example by thermo-compression bonding using an intermediate layer of aluminum. The thus formed photocathode assembly of the vacuum photoelectronic device with the semi-transparent photocathode is subjected to vacuum heating up to a temperature of 600-620° C. and, thus, the surface of the layers 7 of the heteroepitaxial structure of gallium nitride compounds is cleaned. The cleaned surface of the heteroepitaxial structure of gallium nitride compounds is activated with cesium and oxygen by known methods, thereby ensuring a high level of quantum yield of the semi-transparent photocathode of the photocathode assembly of the vacuum photoelectronic device.

The thus manufactured photocathode assembly of the vacuum photoelectronic device is characterized, in contrast to the technical solution of the closest prior art, by a wider application area, by a higher level of the quantum yield of the semi-transparent photocathode, and by the ability to meet the requirement for uniform resolving power over the operational field of the screen of the vacuum photoelectronic device in the case of using the claimed photocathode assembly within a proximity-focused direct view electron-optical converter, which is evidenced by the results of tests of photocathode assembly samples. Thus, the results of the tests performed show that the photocathode assembly samples of the vacuum photoelectronic device embodying the technical solution of the closest prior art and comprising the semi-transparent photocathode with a standard diameter of 18 mm lose their vacuum tightness in three percent of the tests, and those with a standard diameter of 25 mm in one hundred percent of the tests and, moreover, this happens after a single-time heating to temperatures of 600-620° C. In this case, the out-of-flatness of the sapphire disk of the input window in the photocathode assembly samples of the closest prior art is 50 μm. In contrast to this, the photocathode assembly samples of the vacuum photoelectronic device which have been manufactured in accordance to the claimed technical solution and which comprise the semi-transparent photocathode with a standard diameter of 25 mm retain the vacuum tightness in one hundred percent of the tests even when heated to the temperatures of 600-620° C. up to ten times. These test results confirm the wider application area of the claimed technical solution of the photocathode assembly of the vacuum photoelectronic device with the semi-transparent photocathode, in contrast to the technical solution of the closest prior art. At the same time, these test results confirm the feasibility of temperature conditions of heating-up the heteroepitaxial structure prior to its activation which are necessary for causing a high level of quantum yield of the semi-transparent photocathode, while maintaining the vacuum tightness at these temperature conditions and hence the suitability of the photocathode assembly for use thereof within the vacuum photoelectronic device. Moreover, in all the cases of testing the claimed photocathode assembly samples by heating to the temperatures of 600-620° C., the out-of-flatness of the sapphire disk of the input window thereof does not exceed 10 μm. Such a small degree of the out-of-flatness of the sapphire disk of the input window and, accordingly, of the surface of the semi-transparent photocathode of the claimed photocathode assembly of the vacuum photoelectronic device ensures a sufficient degree of uniformity of the resolving power distribution over the operational field of the screen of the proximity-focused direct view electron-optical converter, in the case the photocathode assembly according to the claimed technical solution is used therein. Thus, the test results show a better technical and operational performance of the claimed technical solution of the photocathode assembly of the vacuum photoelectronic device with the semi-transparent photocathode as compared to the technical solution of the closest prior art.

We claim:

1. A photocathode assembly of a vacuum photoelectronic device with a semi-transparent photocathode, said photocathode assembly comprising an input window made in the form of a sapphire disk, layers of a heteroepitaxial structure of gallium nitride compounds as the semi-transparent photocathode, said layers being grown on an inner surface of the input window, and an element for coupling the input window with a housing of the vacuum photoelectronic device, said element being vacuum-tightly attached to an outer surface of the input window at its periphery, wherein the element for coupling the input window with the housing of the vacuum photoelectronic device is made of a bimetal in which a layer being not in contact with the outer surface of the input window consists of a material with having a linear thermal expansion coefficient different from the linear thermal expansion coefficient of sapphire by not more than 10% in the temperature range from 20° C. to 200° C.

2. The photocathode assembly of a vacuum photoelectronic device with a semi-transparent photocathode according to claim 1, wherein kovar is used as the material having a linear thermal expansion coefficient different from the linear thermal expansion coefficient of sapphire by not more than 10% in the temperature range from 20° C. to 200° C.

3. The photocathode assembly of a vacuum photoelectronic device with a semi-transparent photocathode according to claim 1, wherein the layers of the heteroepitaxial structure of gallium nitride compounds include a GaN compound.

4. The photocathode assembly of a vacuum photoelectronic device with a semi-transparent photocathode according to claim 1, wherein the layers of the heteroepitaxial structure of gallium nitride compounds include an AlGaN compound.

5. The photocathode assembly of a vacuum photoelectronic device with a semi-transparent photocathode according to claim 1, wherein the element for coupling the input window with the housing of the vacuum photoelectronic device is made in the form of a rotation figure having a profile of predetermined shape.

6. The photocathode assembly of a vacuum photoelectronic device with a semi-transparent photocathode according to claim 1, wherein a thickness of the sapphire disk is from 0.4 mm to 0.7 mm.

* * * * *